US007818820B2

(12) United States Patent
Tsujimoto

(10) Patent No.: US 7,818,820 B2
(45) Date of Patent: Oct. 26, 2010

(54) BODY PROTECTOR

(76) Inventor: Takeshi Tsujimoto, 28-3, Nishiki-cho, Kawachinagano-shi, Osaka (JP) 586-0031

( * ) Notice: Subject to any disclaimer, the term of this patent is extended or adjusted under 35 U.S.C. 154(b) by 197 days.

(21) Appl. No.: 11/736,136

(22) Filed: Apr. 17, 2007

(65) Prior Publication Data

US 2008/0120768 A1 May 29, 2008

(30) Foreign Application Priority Data

Apr. 17, 2006 (JP) ..... 2006-113565

(51) Int. Cl.
*A41F 19/00* (2006.01)

(52) U.S. Cl. ..... 2/310

(58) Field of Classification Search ..... 2/455, 2/456, 462–464, 466–467, 310, 102, 2.5
See application file for complete search history.

(56) References Cited

U.S. PATENT DOCUMENTS 4,481,679 A * 11/1984 Hayes ..... 2/463
5,232,424 A * 8/1993 Pearson et al. ..... 482/106
5,548,843 A * 8/1996 Chase et al. ..... 2/102
5,937,447 A * 8/1999 Howell ..... 2/463
6,769,137 B2 * 8/2004 D'Annunzio ..... 2/102

FOREIGN PATENT DOCUMENTS

JP 35-17726 7/1960
JP 56-28371 8/1979
JP 61-88771 6/1986

* cited by examiner

*Primary Examiner*—Tejash Patel
(74) *Attorney, Agent, or Firm*—Knobbe Martens Olson & Bear LLP

(57) ABSTRACT

The invention provides a body protector which can be simply and easily installed and detached by hands of an athlete himself or herself, and can be finely adjusted properly by the hands of the athlete himself or herself after installation. Fastening bands are made detachable via a surface fastener provided during an overlapping under a relation that the fastening bands are structured as a pair of right and left parts respectively extending from both right and left side portions of a protector main body so as to be overlapped with each other, suspending bands are structured such as to extend from two right and left symmetrical positions in an upper portion of the protector main body, and a leading end side of the suspending band is freely attached to and detached from the fastening bands via the surface fastener.

10 Claims, 3 Drawing Sheets

BODY PROTECTOR

BACKGROUND OF THE INVENTION

1. Field of the Invention

The present invention relates to a body protector, in detail relates to a body protector used at a time of executing combat sports such as a boxing, a karate, a taekwondo, a kick boxing and the like, and particularly relates to a body protector for effectively protecting an upper half of the body of an athlete during a game of the combat sports by installing so as to cover a front surface of the upper half of the body of the athlete.

2. Description of the Related Art

In recent years, in order to protect the body of the athlete, particularly the upper half of the body from a butt and a kick of an opponent applied in some cases at a time of a game and an exercise of the karate, the taekwondo or the like, there is employed a body protector for the combat sports shown in FIG. 5. FIG. 5 shows a state at a time of installing the body protector to an athlete M (that is seen from a back portion in the drawing), and the body protector is provided with a protector main body 42 structured by comparting two back and front convex cloth covers 40 vertically and horizontally, and arranging a cushioning material 41 in an inner portion of the covers, and is installed such that the protector main body 42 is fitted to a whole so as to reach both sides of a back from a front surface of the upper half of the body corresponding to a chest portion and an abdominal portion via both armpits. Accordingly, the protector main body 42 is provided with a fastening band 43 around the back and is provided with a suspending band 44 between an upper portion of the main body 42 and a portion around the back, and these bands are structured detachably, whereby the protector main body 42 can be installed in a state of being fitted to the body of the individual athlete M.

SUMMARY OF THE INVENTION

However, since the body protector shown in FIG. 5 is structured as a type in which the fastening band and the suspending band are installed in the back of the athlete M by a manual fastening, there is a disadvantage that the body protector can not be installed without being aided by the other person than the athlete M, and can not be detached without being aided by the other person even after finishing the game. Further, since the body protector is installed by the other person, it is hard to finely adjust to a proper state even if any problem is generated.

Accordingly, the present invention is made by taking the problem in the prior art mentioned above into consideration, and an object of the present invention is to provide a body protector which can be simply and easily installed and detached by hands of an athlete himself or herself, and can be finely adjusted properly by the hands of the athlete himself or herself after installation.

The object mentioned above can be achieved by the invention described in claims. In other words, in accordance with the present invention, there is provided a body protector including:

a protector main body having a cushioning function in a whole surface and structured such as to fit to at least both armpits from a front surface side of an upper half of a body including a chest portion and an abdominal portion of an athlete;

fastening bands serving as a band-like member, extending from right and left side portions of the protector main body so as to form a pair and holding the protector main body around the body so as to freely fasten by detachably connecting a pair of right and left fastening bands; and suspending bands detachably connecting between an upper portion of the protector main body and the fastening band from a portion around a shoulder to a back side so as to hold the protector main body, wherein the fastening bands are made detachable via a surface fastener provided during an overlapping under a relation that the fastening bands are structured as a pair of right and left parts respectively extending from both right and left side portions of the protector main body so as to be overlapped with each other, the suspending band is structured such as to extend from two right and left symmetrical positions in an upper portion of the protector main body, and a leading end side of the suspending band is freely attached to and detached from the fastening band via the surface fastener.

In accordance with this structure, at a time of installing the body protector, the suspending band is previously turned to the rear from the portion around the shoulder so as to be set to the fastening band via the surface fastener at a predetermined length, both hands are next passed into an annular portion formed by the suspending band and the fastening band, and the protector main body is thereafter fitted to the front surface of the upper half of the body, and is set by the surface fastener while turning the fastening band extending to both sides to the back so as to overlap and tighten. These installations can be all executed by the hands of the athlete himself or herself through one-touch operation by using the surface fastener, and can be simply and easily executed finely by detaching or resetting the surface fastener by the hands of the athlete himself or herself even after the installation, whereby it is possible to obtain a suitable state which is in tune with the body type of the athlete himself or herself.

It is preferable that the suspending bands are constituted by a pair of right and left independent bands extending from two positions corresponding to right and left symmetrical positions of an upper portion of the protector main body, and are capable of being crossed on the back, and respective leading end sides of the suspending bands are detachable via a surface fastener so as to form a symmetrical shape in the fastening band side.

In accordance with the structure, it is possible to install the suspending bands to the fastening band side by the surface fastener so as to form the symmetrical shape by crossing the suspending bands, and it is possible to suspend and hold the fastening bands with a good balance laterally. Therefore, it is possible to prevent a displacement of the protector main body during the game, and it is possible to always keep a proper initial installed state.

It is preferable that the suspending bands are constituted by a pair of right and left upper portions extending from two positions corresponding to right and left symmetrical positions in an upper portion of the protector main body, and a single lower portion extending from the upper portions, and a leading end of the lower portion is freely attached to and detached from the fastening band side via the surface fastener.

In accordance with the structure, it is possible to simply and securely install the body protector by the hands of the athlete himself or herself, by setting the lower portion of the suspending band to a state in which the lower portion of the suspending band is installed to the one fastening band by the surface fastener, handing the body protector around a neck through an annular portion formed by a pair of upper portions and the upper portion of the protector main body, and thereafter setting the other fastening band to the one fastening band by the surface fastener. In this case, the structure may be made such that a pair of fastening bands are previously set and the suspending bands are later set to the fastening bands.

It is preferable that the fastening band is provided with a hanging portion capable of returning through a leading end side of each of the suspending bands, and is detachable via the surface fastener after being passed through the hanging portion. In accordance with the structure, it is possible to pass the suspending bands through the hanging portion so as to lift up, and thereafter set the suspending bands by the surface fastener, whereby it is possible to set the fastening bands in a lifted state and install the protector main body in the tightened state.

DETAILED DESCRIPTION OF THE PREFERRED EMBODIMENTS

A description will be given in detail of embodiments in accordance with the present invention with reference to the accompanying drawings.

First Embodiment

Figure 1:
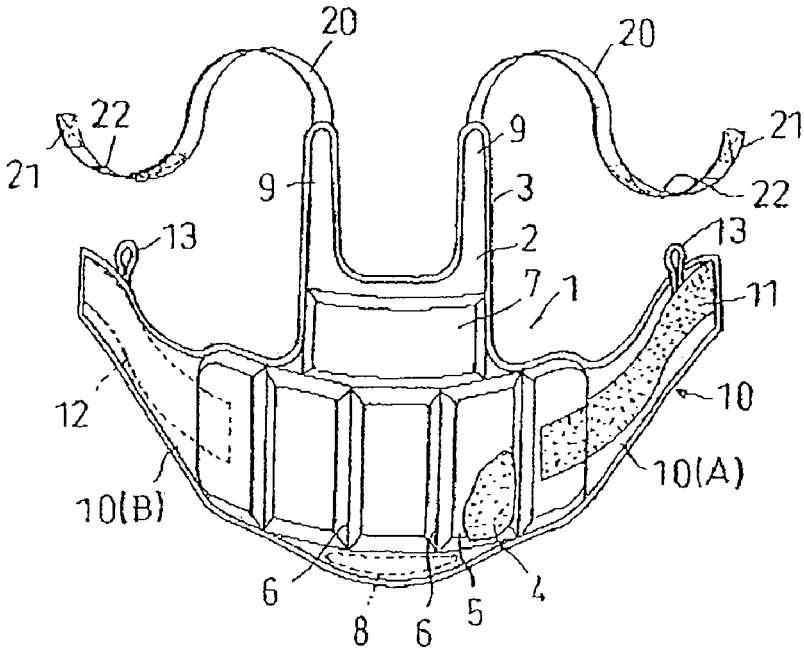
FIG. 1 is a partly broken perspective view from a front side showing a body protector in accordance with a first embodiment of the present invention in a non-installed state.
Figure 2:
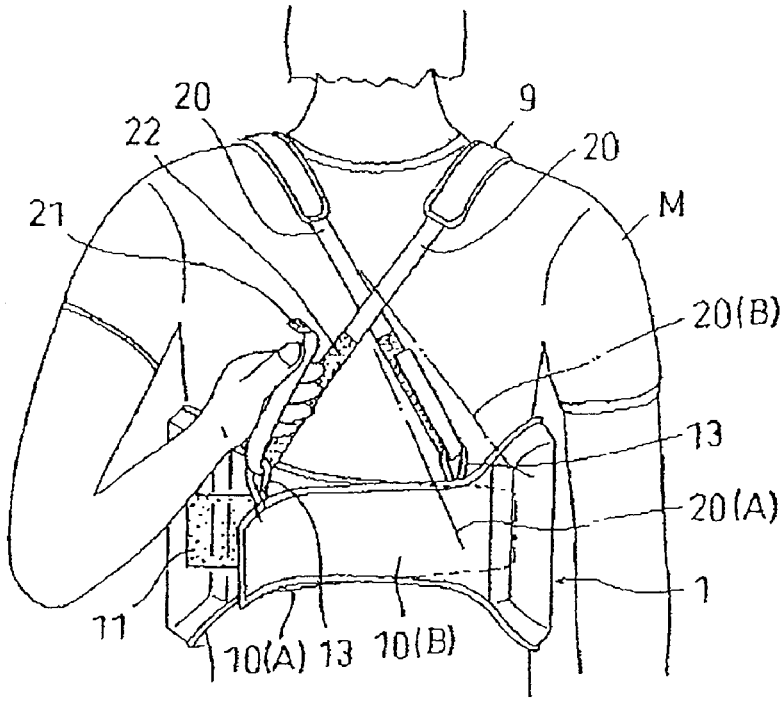
FIG. 2 is a back elevational view showing an installed state in a first stage of the body protector in FIG. 1.
Figure 3:
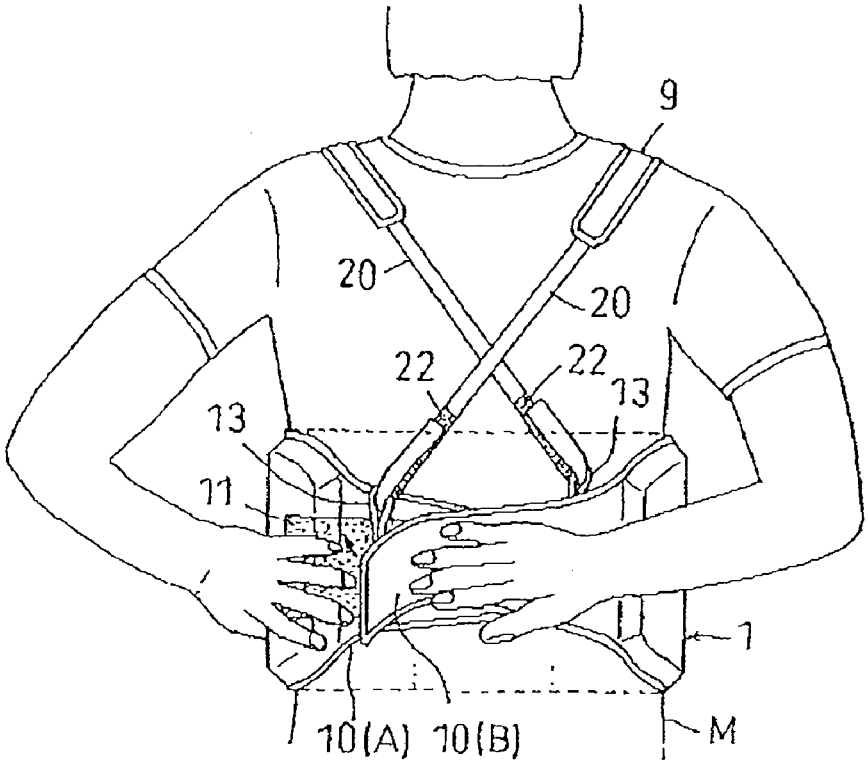
FIG. 3 is a back elevational view showing an installed state in a second stage of the body protector in FIG. 1.

FIG. 1 is a perspective view from a front side showing a body protector in accordance with a first embodiment in a non-installed state, FIG. 2 is a back elevational view showing an installed state in a first stage of the body protector in accordance with the first embodiment, and FIG. 3 is a back elevational view showing an installed state in a second stage of the body protector in accordance with the first embodiment. In this case, as combat sports in which the body protector in accordance with the first embodiment is used, there can be exemplified a boxing, a karate, a taekwondo, a kick boxing and the like, however, the combat sports are not limited to them.

The body protector in accordance with the first embodiment is provided with a protector main body 1 which is formed in a convex flat shape as seen from a front surface, and a pair of fastening bands 10 extending from both right and left sides of the main body 1, and is integrally structured by a pair of right and left suspending bands 20 extending as independent bands from an upper portion of the protector main body 1. Further, since the body protector does not use a bracket, the body protector can be used with a safe conscience.

The protector main body 1 and the fastening band 10 are provided with a front cover 2 which is visible from a direction in FIG. 1 and a rear cover which is disposed in an opposite side. These front and rear covers are of reversible type, there is a relation that the front cover 2 comes to the rear cover and the rear cover comes to the front cover. These front and rear covers may be formed as one sheet shape as a whole by cutting a soft resin sheet, may employ a cloth material or the other coating materials, or may be formed by bonding a plurality of sheets in accordance with a sewing or the like. Further, the cover may be formed porous or may be formed as a mesh partly or as in a whole surface for absorbing sweat. The front and rear covers are structured such that an outer peripheral edge is fastened by a stop edge 3, and a plurality of main cushioning members 4 (shown in FIG. 1 in a partly broken manner) are simultaneously loaded in a lateral width direction to a center armor-shaped portion. The main cushioning members 4 are formed in a rectangular vertically long shape, and are enwrapped by a main loading portion 5 formed over plural rows in a width direction, and the main loading portion 5 with the main cushioning members 4 is structured such as to be bendable to the front and rear via a bending portion 6. In this case, the main loading portions 5 are all arranged symmetrically on the basis of a vertical center line of the main loading portion 5 in the center.

An upper loading portion 7 for protecting the chest portion is formed as a wide shape in an upper side than the main loading portion 5 of the protector main body 1, a cushioning member (not shown) is loaded and formed in an inner portion in the same manner, and an auxiliary cushioning member 8 is loaded to a lower end portion of the protector main body 1. In this case, the upper loading portion 7 is formed as the wide shape so as to get over a plurality of blocks of the main loading portion 5, however, may be structured, for example, such as to be bendable independently with a bending portion so as to exist on an extension of the bending portions 6 and 6 corresponding to both sides of the center main loading portion 5. In accordance with this structure, the bending of the main loading portion 5 is more freely bended and a fitting characteristic of the body protector to the body is improved. In the case of using a comparatively soft cushioning member, it is not necessary that the cushioning member is structured as a plurality of blocks. It is preferable that these cushioning members 4 and 8 are structured by sandwiching both surfaces of a resin high elastic foamed material by a resin high shock absorbing high density foamed material so as to laminate. As the high elastic foamed material, for example, it is possible to employ a rubber elastic foamed material such as a soft styrene elastomer crosslinked foamed material or the like, it is preferable that the high shock absorbing high density foamed material is constituted, for example, by a high density polyurethane foam, and it is particularly preferable to employ a memory foam (having a ball rebound rate 5 to 10% (a shock absorbing rate 90 to 95%), sales agency: Yamako Yugyo Co., Ltd.).

In an upper portion of the protector main body 1, upper band pieces 9 forming two lobes in a symmetrical relation are integrally protruded, and the suspending bands 20 are attached respectively via the upper band pieces 9. The suspending bands 20 are constituted by the band bodies having the same length, a first surface fastener 21 is provided in a leading end of the suspending band 20, and a second surface fastener 22 is provided in a side forming an inverse surface to the surface fastener 21. The both surface fasteners 21 and 22 have a relation of being locked by bending the first surface fastener 21 in the leading end in a U-shaped form.

The fastening bands 10 are structured such as to integrally extend from both sides of the protector main body 1, and these fastening bands 10 and 10 have a symmetrical relation. In this case, reference symbol (A) is attached to the right fastening band 10 and reference symbol (B) is attached to the left fastening band 10 in FIG. 1 (the fastening band may be expressed by reference numeral 10 representatively). Each of the fastening bands 10(A) and 10(B) is formed in a taper shaped (may be formed in a uniform width shape), is provided with a long band shaped inner surface fastener 11 in one surface (a right surface in FIG. 1) so as to extend to a band leading end from an end portion of the protector main body 1, and is provided with a long band shaped outer surface fastener 12 in the other back surface (a left back surface in FIG. 1) so as to extend to a band leading end from an end portion of the protector main body 1 in the same manner. Further, a hanging portion 13 in a form protruding and facing to an upper side from the fastening band 10 is provided in an upper edge leading end side of each of the surface fasteners 11 and 12.

Since the hanging portions 13 and 13 correspond to the symmetrical positions as shown in FIG. 2 as seen from a back surface at a time of installing the body protector in accordance with the first embodiment described above, one of two suspending bands 20 is turned obliquely to the rear side so as to be hanged to one hanging portion 13, and is thereafter somewhat pulled, and the terminal end portion is thereafter fastened by the first and second fasteners 21 and 22. If the other remaining suspending band 20 is fastened in the same manner, the protector main body 1 is pulled upward, and it is possible to obtain a wholly fitted state to the body.

After the terminal end portion is fastened by the first and second surface fasteners 21 and 22, both hands are passed into an annular portion formed by the suspending bands and the fastening bands, and the protector main body is thereafter set by the surface fastener while turning the fastening bands extending to both sides to the rear so as to overlap and tighten in such a manner as to fit the protector main body in the front surface of the upper half of the body. In other words, both fastening bands 10(A) and 10(B) are turned to the rear in such a manner as to fit the protector main body 1 to the body front surface by the hand of the athlete M himself or herself. At this time, the fastening band 10(A) provided with the inner surface fastener 11 is first turned to the rear of the body portion, and the fastening band 10(B) provided with the outer surface fastener 12 is later lapped over the fastening band 10(A) while being pulled so that the protector main body 1 is tightened. Accordingly, both the surface fasteners 11 and 12 are locked to each other, and both the fastening bands 10(A) and 10(B) are strongly coupled to each other in accordance with a so-called one-touch operation. At a time of using reversibly, the fastening bands are coupled in such a manner that the fastening band 10(B) in the left side in FIG. 1 is first set and the right fastening band 10(A) laps over the fastening band 10(B). These operations can be all executed by the hands of the athlete M himself or herself. In the case that some problem exists in a fitting feeling, an ex-post adjustment can be executed by the hands of the athlete M himself or herself by peeling the fastening band 10(B) and finely adjusting the band 10(B) while again tightening or loosening the band 10(B), and thereafter locking both the surface fasteners 11 and 12.

At a time of installing the body protector so as to conduct a game, both the fastening bands 10(A) and 10(B) and both the suspending bands 20 and 20 are both locked in a pulling manner, and the protector main body 1 is firmly fitted to the front surface of the body. Particularly, since the suspending bands 20 and 20 are pulled in the symmetrical crossing manner, there is no risk that the suspending bands 20 and 20 displace even if the athlete is exposed to the butt, the kicking or the like during the game, and it is possible to keep a stable state.

In the case of detaching the body protector, the body protector can be detached so as to get out both hands by first detaching the fastening bands 10(A) and 10(B) without detaching the suspending band 20. Accordingly, it is possible to install the body protector in a free state in which the fastening bands 10(A) and 10(B) are separated, as it is while the suspending band 20 is inversely in a coupled state. In other words, it is possible to finish the installation through a one-touch operation by putting both the suspending bands 20 over the shoulders and locking and coupling both the free fastening bands 10(A) and 10(B) so as to tighten. As a matter of fact, the body protector may be completely detached by detaching both the suspending bands 20 and 20 by detaching the first surface fastener 21 from the second surface fastener 22 so as to pull out the leading end portion of the suspending band 20 from the hanging portion 13, and detaching the one fastening band 10(B) from the other fastening band 10(A).

In this case, as shown by an imaginary line 20(A) in FIG. 2, the suspending band may be structured such as to be directly lockable to the fastening band 10(B) or 10(A) by the surface fastener. In this case, the hanging or detaching operation with respect to the hanging portion 13 becomes simplified. Further, as shown by an imaginary line 20(B) in FIG. 2, the suspending band may be structured such as to be directly locked to both the right and left side portions of the protector main body 1 or be locked thereto via the hanging portion 13. In this case, it becomes easy to pass the hands so as to easily install, and it is possibly to simply and securely adjust.

Further, the suspending band 20 is originally set to the independent band type, however, may be set to a type that the crossing portions are previously coupled so as to be formed in an X-shaped form, an upper end thereof is joined to an upper portion of the protector main body 1, and a lower end thereof is attached to and detached from the fastening band 10 side by the surface fastener. In this case, in the case of the independent band type, the band may be constituted by suspending bands which are vertically set in the back view and are in parallel to each other, or suspending bands which are formed in a tapered shape in the back view.

Second Embodiment

Figure 4:
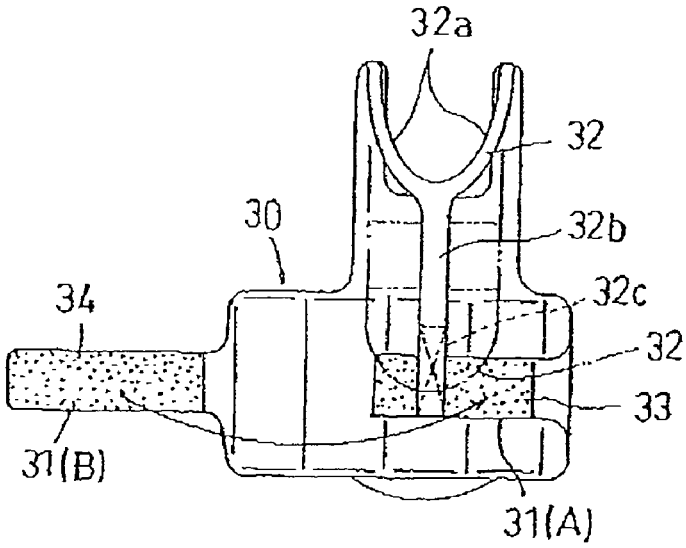
FIG. 4 is a back elevational view showing a body protector in accordance with a second embodiment of the present invention in a non-installed state.
Figure 5:
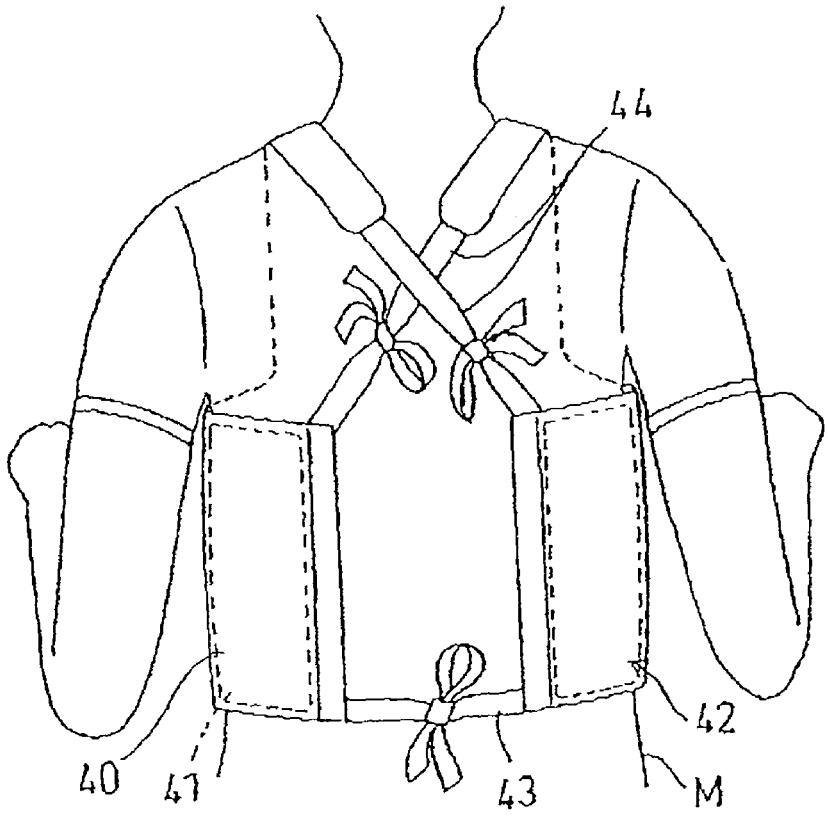
FIG. 5 is a back elevational view showing an example of a prior art of a body protector in an installed state.

FIG. 4 is a back elevational view showing a body protector in accordance with a second embodiment in a non-installed state. A protector main body 31 is the same as that of the first embodiment, however, the structure is different in a point that fastening bands 31 constituted by a pair of fastening bands 31(A) and 31(B) are not provided with the hanging portions 13 mentioned above. A suspending band 32 is different from the embodiment mentioned above in a point that two upper portions 32*a* are formed in a U-shaped form so as to a neck hanging type, and a point that a lower portion 32*b* is arranged in one. In this case, the suspending band 32 is formed in a Y-shaped form.

In order to install the body protector in accordance with the second embodiment, the lower portion of the suspending band 32 is locked onto a first surface fastener 33 of the fastening band 30(A) by a surface fastener 32*c* provided in a back surface of the suspending bang 32 or previously coupling the lower portion of the suspending band 30 without the surface fastener 32*c*, and passing a head into the upper portion 32*a* under the state mentioned above so as to hang on the shoulder. Since the suspending band 32 and the right fastening band 31(A) are in the back surface of the athlete, the installation is finished by locking the left fastening band 31(B) on the right fastening band 31(A). Therefore, in accordance with the second embodiment, since the installation can be finished only by locking the one free fastening band 31(B) to the other fastening band 31(A) in addition to the operation hanging on the shoulder, not only it is possible to install the body protector in accordance with a very simple operation of the athlete himself or herself, but also it is possible to detach in a very easy manner.

In this case, the surface fastener 32*c* is provided on the back surface in the lower portion of the suspending band 32, however, if the surface fastener is provided in the front surface, the surface fastener is locked to the second surface fastener 34 in the left side in FIG. 4, and it is possible to obtain a state in which the suspending band 32 is firmly coupled to the fastening band 30 side.

Further, as shown by an imaginary line in FIG. 4, the suspending band 32 may be formed in a U-shaped form or a V-shaped form. In this case, it is preferable that the suspending bands are structured as a symmetrical type for improving an installation stability of the body protector.

What is claimed is:

1. A body protector comprising:

a protector main body having a cushioning function provided by at least one cushioning member attached thereto structured such as to fit to at least both armpits from a front surface side of an upper half of a body including a chest portion and an abdominal portion of an athlete;

first and second fastening bands serving together as a band-like member, extending from right and left side portions of the protector main body, respectively so as to form a pair and holding the protector main body around the body so as to freely fasten by detachably connecting a pair of right and left fastening bands; and suspending bands detachably connecting between an upper portion of the protector main body and the fastening band from a portion around a shoulder to a back side so as to hold the protector main body, wherein the fastening bands overlap each other to create an overlapped portion when the body protector is worn and are detachably connected each other by attaching first and second hook and loop fastener materials provided on the overlapped portion of the first and second fastening bands, respectively, the suspending band is structured by a pair of right and left independent bands extending from two positions in an upper portion of the protector main body, and each leading end side of the suspending band is freely attached to and detached from the overlapped portion of the fastening band via third and fourth hook and loop fastener materials provided on the right and left independent bands respectively, and the suspending band on the left-hand side is hung between the left-hand side of the upper portion of the protector main body and the overlapped portion of the fastening band on the left-hand side, the suspending band on the right-hand side is hung between the right-hand side of the upper portion of the protector main body and the overlapped portion of the fastening band on the right-hand such that the pair of suspending bands crosses on the back when the fastening bands are fastened.

2. The body protector as claimed in claim 1, wherein the suspending bands are constituted by a pair of right and left independent bands extending from two positions corresponding to right and left symmetrical positions of an upper portion of the protector main body, and are capable of being crossed on the back, and respective leading end sides of the suspending bands are detachable via a hook and loop fastener so as to form a symmetrical shape in the fastening band side.

3. The body protector as claimed in claim 1, wherein the suspending bands are constituted by a pair of right and left upper portions extending from two positions corresponding to right and left symmetrical positions in an upper portion of the protector main body, and a single lower portion extending from the upper portions, and a leading end of the lower portion is freely attached to and detached from the fastening band side via the hook and loop fastener.

4. The body protector as claimed in claim 2, wherein the fastening band is provided with a hanging portion capable of returning through a leading end side of each of the suspending bands, and is detachable via the third and fourth hook and loop fastener materials after being passed through the hanging portion by attachment to fifth and sixth hook and loop fastener materials on said right and left independent bands respectively.

5. The body protector as claimed in claim 3, wherein the fastening band is provided with a hanging portion capable of returning through a leading end side of each of the suspending bands, and is detachable via the third and fourth hook and loop fastener materials after being passed through the hanging portion by attachment to fifth and sixth hook and loop fastener materials on said right and left independent bands respectively.

6. The body protector as claimed in claim 1, wherein the protector main body and the fastening band are provided with a front cover and a rear cover where the front and rear covers are reversible.

7. The body protector as claimed in claim 6, wherein surface of the front and rear covers are formed with a porous material or a mesh material.

8. The body protector as claimed in claim 1, wherein each of the suspending bands is lockable to each of the fastening bands.

9. The body protector as claimed in claim 1, wherein the suspending bands are formed in a Y-shaped form.

10. The body protector as claimed in claim 1, wherein the hook and loop fastener is provided on both sides of a leading end of the suspending band.

* * * * *